US005758696A

United States Patent [19]

Nishikawa

[11] Patent Number: 5,758,696

[45] Date of Patent: Jun. 2, 1998

[54] FE-CR-NI ALLOY FOR WEAR-RESISTANT LOOM PARTS

[75] Inventor: Kiyoaki Nishikawa, Kanagawa, Japan

[73] Assignee: Nippon Mining & Metals Co., Ltd., Tokyo, Japan

[21] Appl. No.: 710,999

[22] Filed: Sep. 26, 1996

[30] Foreign Application Priority Data

Sep. 27, 1995 [JP] Japan ..... 7-249159

[51] Int. Cl.[6] ..... D03D 49/62

[52] U.S. Cl. ..... 139/1 R; 139/92; 139/93; 139/192

[58] Field of Search ..... 139/92, 192, 93; 428/136, 420, 469; 148/325; 420/43; 242/615.4

[56] References Cited

U.S. PATENT DOCUMENTS

| | | | |
|---|---|---|---|
| 4,492,256 | 1/1985 | Kramer | 139/92 |
| 5,447,181 | 9/1995 | Tahara et al. | 139/192 |
| 5,511,587 | 4/1996 | Miya et al. | 139/192 |

FOREIGN PATENT DOCUMENTS

| | | | |
|---|---|---|---|
| 0 550 752 | 7/1993 | European Pat. Off. | 139/192 |
| 5-332442 | 2/1993 | Japan | 139/192 |
| 6-200451 | 7/1994 | Japan | 139/192 |
| 92/06234 | 4/1992 | WIPO | 139/192 |

*Primary Examiner*—Andy Falik
*Attorney, Agent, or Firm*—Kubovcik & Kubovcik

[57] ABSTRACT

An Fe-Cr-Ni alloy used for parts of an automatic loom such as a heald (7) and reed (12) consisting of from 13 to 20% of Cr, from 4 to 15% of Ni, the balance being Fe and unavoidable impurities, and having a microstructure that is 60% or more strain-induced martensite. Wear resistance of the parts is improved, so that neither fluff nor rupture of yarn occurs during loom operation.

9 Claims, 2 Drawing Sheets

FE-CR-NI ALLOY FOR WEAR-RESISTANT LOOM PARTS

BACKGROUND OF INVENTION

1. Field of Invention

The present invention relates to an Fe-Cr-Ni alloy useful for a part of an automatic loom as well as a wear-resistant part of an automatic loom. More particularly, the present invention relates to an Fe-Cr-Ni alloy with improved wear-resistance against yarn.

2. Description of Related Arts

Parts of an automatic loom, which are brought into contact with yarn, include a reed and a heald as described below.

Referring to FIG. 1, a plurality of neck yarn 2 is moved upward or downward according to the information in a Jacquard paper, by means of a Jacquard driving mechanism 1. A plurality of harness cords 3 are connected to the lower ends of the neck cord and pass through a plurality of apertures 5 of a comber board 6. The lower ends of the harness cords 3, which pass through the comber board 6, are secured to a heald 7. The weft (not shown) pass through the apertures 7*a* of the heald 7. The heald 7 lifts up successively and vertically displaces the weft. As a result, a reed hole is formed between a number of wefts and allows a shuttle, in which warps are mounted, to pass therethrough. Restoring springs 8 are connected to the bottom of the heald 7 at one end thereof and a the fixing bed 9 at the other end.

Referring to FIG. 2, a reed apparatus 10 is located in front of the heald 7 and comprises a reed chamber 11 in the form of a trapezoidal frame and reed wires 12. Warp 16 passes through between the reed blades 12 and then through the apertures 7*a* of the heald.

Conventionally, the reed 12 and heald 7 are made of a hardsteel sheet or hard-steel wire. The reed 12 and heald 7 are replacable parts liable to wear out due to sliding contact with the yarn. When these parts wear out, minute grooves, referred to as yarn passes, are formed on the parts with the result that such anomalies as fluff and rupture of yarn arise. Operation of an automatic loom will thus be interrupted or its parts must be replaced by new parts, resulting in inconvenience in the operation of the automatic loom. In the worst case, defects are formed on the product.

Furthermore, along with an increase of speed of newer automatic looms, their parts are brought into contact with much longer length of yarn as compared with conventional looms.

Accordingly, fluff and yarn ruptures occur in very short periods of operation that would not occur in a conventional automatic loom. Level of wear-resistance required for parts of an automatic loom have become therefore more stringent than that of conventional parts. In addition, since new textile materials have been developed, the parts of an automatic loom must exhibit wear-resistance against such materials also.

SUMMARY OF INVENTION

Mere increase in hardness of parts of an automatic loom cannot successfully prevent the fluff and yarn rupture due to the formation of yarn passage on such parts.

It is an object of the present invention to provide an Fe-Cr-Ni alloy which has a microstructure capable of improving wear-resistance against yarn.

It is also an object of the present invention to provide a sliding part having highly enhanced wear resistance with respect to yarn.

In accordance with the objects of the present invention, there is provided an Fe-Cr-Ni alloy for use as a part of an automatic loom, which part will be in sliding contact with yarn, characterized in that the Fe-Cr-Ni alloy consists of, by weight percentage, from 13 to 20% of Cr, from 4 to 15% of Ni the balance being Fe and unavoidable impurities, and has a microstructure such that 60% or more, preferably 70% or more based on the matrix is a strain-induced martensite.

In accordance with the objects of the present invention, there is provided a part of an automatic loom, which part will be in sliding contact with yarn and consisting of the Fe-Cr-Ni alloy mentioned above.

BRIEF DISCRIPTION OF THE DRAWINGS

DESCRIPTION OF PREFERRED EMBODIMENTS

Figure 1:
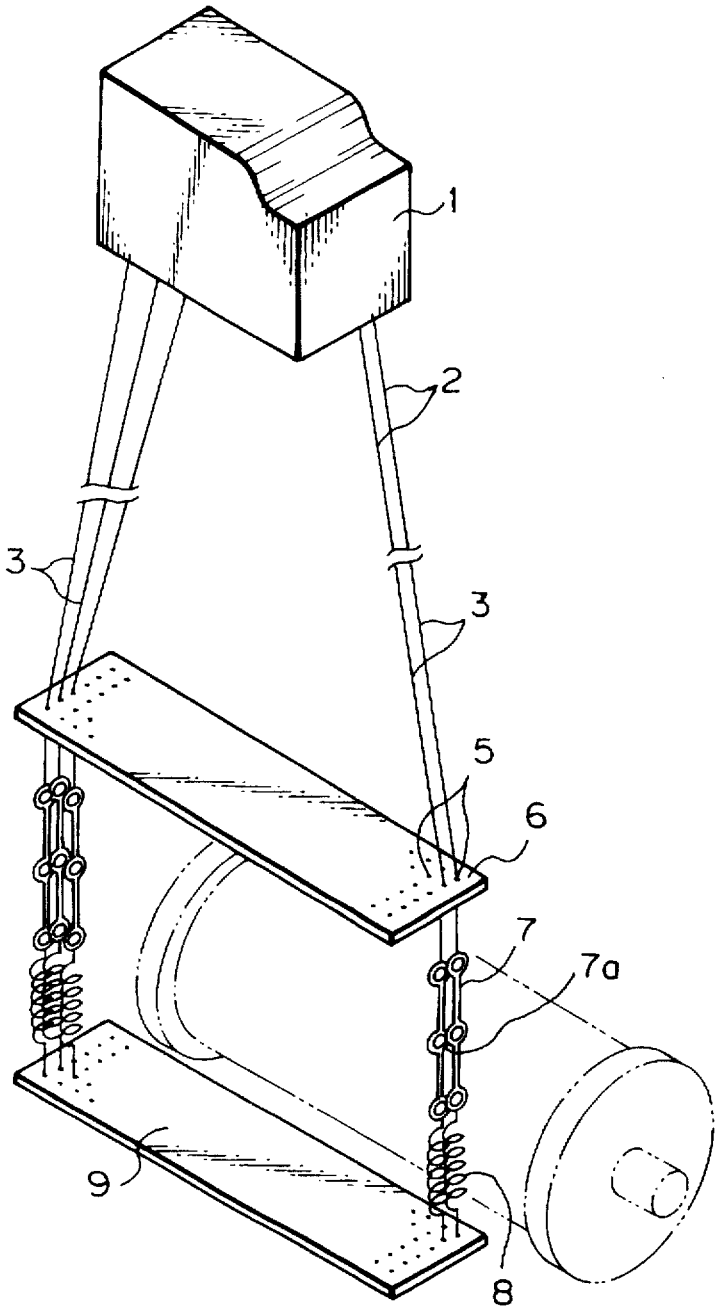
Fig. 1 PRIOR ART
FIG. 1 illustrates as prior art a Jacquard-type opening machine which is shown in Japanese Unexamined Patent Publication No. 4-136,228 and which is operated to form, between the warps, a space for drawing-in the reed.
Figure 2:
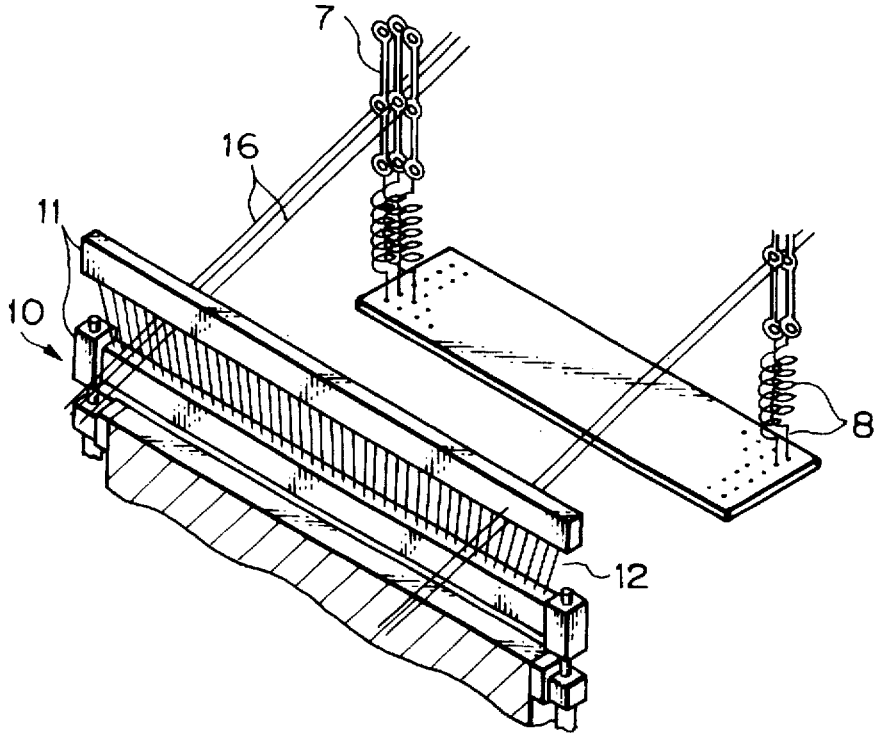
Fig. 2 PRIOR ART
FIG. 2 illustrates a reed apparatus for beating, used in the apparatus shown in FIG. 1.

The Fe-Cr-Ni alloy according to the present invention exhibits an exceedingly high wear-resistance against yarn sliding thereon at a high speed, so that the fluff and rupture of yarn can successfully be minimized. Corrosion resistance of the Fe-Cr-Ni alloy is excellent. The inventive alloy has excellent formability to be shaped into parts of an automatic loom.

The alloying components of the Fe-Cr-Ni alloy according to the present invention are first described.

Cr: The parts of an automatic loom are required to have corrosion resistance because the automatic loom is used under various circumstances. For example, parts may come in contact with water which is used in some types of automatic looms. The corrosion resistance of Fe-Cr-Ni can be attained by adjusting the Cr content within an appropriate range. When the Cr content is less than 13%, the corrosion resistance is poor. On the contrary, when the Cr content is more than 20%, the formability of the Fe-Cr-Ni alloy is impaired. The Cr content is therefore from 13 to 20%. A preferred Cr content is from 15 to 19%.

Ni: Ni contributes to improving the corrosion resistance as does Cr. When the Ni content is less than 4%, the corrosion resistance is impaired. In addition, when the Ni content is less than 4%, since Ni is an austenite-former, the austenite phase is formed with difficulty. It then becomes then difficult to induce the required amount of martensite phase by means of working. On the other hand, when the Ni content is more than 15%, since Ni is an austenite-stabilizing element, the required amount of strain-induced martensite becomes difficult to obtain. In addition, the materials costs are increased when the Ni content exceeds 15%. The Ni content is therefore from 4 to 15%. A preferred Ni content is from 5 to 13%. The elements other than those mentioned above, such as C, P and S are detrimental to the corrosion resistance. Such elements other than the above mentioned ones such as Mn, Al and Si are incidental elements which are not particularly effective for attaining the objects of the present invention. These elements are inevitably included in the Fe-Cr-Ni alloy as impurities, when the alloy is produced by melting the ordinary raw-materials. The content of the impurities is preferably not more than 3.5% in total amount.

It was discovered by the present inventors that the wear resistance of an Fe-Cr-Ni alloy with respect to yarn is greatly dependent upon the amount of the strain induced martensite, even though the composition and hardness of the Fe-Cr-Ni alloy remains constant. For example, when an Fe-Ni-Cr alloy (A) having a strain induced martensite of 50 %, an austenite of 50%, and hardness Hv of 500 is compared with an Fe-Cr-Ni alloy (B) having the same composition as alloy (A) and having a strain induced martensite of 60%, an austenite of 40%, and hardness of Hv=500, the wear resistance of (B) is better than that of (A).

Since the desired wear resistance is not attained by a strain induced content of less than 60%, its weight percentage is specified to be 60% or more. A preferred amount of the strain induced martensite is 70% or more. The strain induced martensite herein indicates that a complete austenitic structure is once formed and is then subjected to working to induce the martensitic transformation in order to convert the gamma phase to an alpha phase. The complete austenitic structure means that the essential elements of the present invention, i.e., Fe, Cr and Ni, form an austenitic matrix, and, further, the impurities are present in the form of minority phases such as carbides and sulfides. The minority phases should be present in such a trace amount that the presence exerts an influence upon the measured valued of the strain induced martensite only within a range of measurement error. The amount of strain induced martensite is obtained by applying external density with an intensity of 199000 A/m (i.e., 2.5 kOe) to an Fe-Cr-Ni alloy, measuring the magnetic flux density B (T), multiplying the magnetic flux density with 100 (i.e., the result) and dividing 100B by 1.6 T.

The Fe-Cr-Ni alloy and a part of an automatic loom according to the present invention can be produced by the following process.

The alloying components satisfying the above mentioned range are melted, cast and subsequently subjected to hot-forging or rolling. The wrought product is, if necessary, subjected to solution heat-treatment. Cold-rolling and subsequent annealing are carried out at least once. Finally, the cold-rolling, which induces martensitic transformation, is carried out, while reducing the thickness from to 0.1 down to 0.3 mm. The obtained rolled sheets are blanking worked by means of, for example, a press machine, to provide the shape for parts of an automatic loom. In the case of producing a wire, a process similar to that used in producing a sheet is carried out.

The present invention is hereinafter described by way of an example.

EXAMPLE

The alloys having a composition as shown in Table 1 were melted and cast into ingots. The ingots were then hot-rolled to form 3 mm thick sheets and then solution heat-treated at 1050° C. for 30 minutes. The resultant structure was completely austenitic. The 3 mm thick hot-rolled sheets were cold-rolled at a reduction of from 50 to 90% and then annealed at 1050° C. This cold-rolling and subsequent annealing were in some cases repeated twice. The resultant 0.3 mm thick sheets had hardness of Hv 540 and various amounts of strain induced martensite.

In order to investigate the wear resistance of the obtained materials, samples having a width of 10 mm were taken. Twenty four filaments with 75 denier were suspended from the sample and a tension of 30 gram was applied to the filaments. The filaments were caused to slide on the sample at a speed of 40 cm/minute. The worn of portions of the samples brought into contact with the filaments were observed. The results are shown in Table 1, below.

TABLE 1

| | | Chemical Composition (wt %) | | | Strain Induced Marten- | Hardness | State of |
|---|---|---|---|---|---|---|---|
| | | Cr | Ni | Fe | site (%) | (Hv) | Wear |
| In-ven-tive Alloys | 1 | 15.8 | 5.2 | Bal | 91 | 554 | Extremely Slight |
| | 2 | 16.3 | 6.5 | Bal. | 85 | 663 | Extremely Slight |
| | 3 | 17.5 | 7.2 | Bal. | 73 | 570 | Slight |
| | 4 | 18.2 | 5.8 | Bal. | 76 | 542 | Slight |
| | 5 | 18.8 | 6.1 | Bal. | 62 | 557 | Slight |
| | 6 | 16.4 | 6.8 | Bal. | 77 | 558 | Slight |
| | 7 | 17.3 | 5.7 | Bal. | 84 | 561 | Slight |
| Compar-ative Alloys | 8 | 16.0 | 6.2 | Bal. | 63 | 557 | Medium |
| | 9 | 17.6 | 5.9 | Bal. | 48 | 542 | Great |
| | 10 | 16.4 | 6.0 | Bal. | 55 | 568 | Medium |
| | 11 | 18.4 | 7.6 | Bal. | 41 | 540 | Great |
| | 12 | 17.8 | 6.5 | Bal. | 50 | 546 | Great |

Criterion for judging the wear was as follows.

Great: clear yarn marks and fluff were recognized.

Medium: clear yarn marks were recognized.

Slight: some yarn marks were recognized.

Extremely slight: very slight yarn passage was recognized.

As is clear from Table 1, although the hardness of the inventive examples is approximately the same as that of the comparative samples, the wear of the former from yarn is less than that of the latter. The wear resistance is therefore improved by the present invention.

I claim:

1. An Fe-Cr-Ni alloy for use as a part of an automatic loom, said part being in sliding contact with a yarn, wherein said Fe-Cr-Ni alloy consists of, by weight percentage, from 13 to 20% of Cr, from 4 to 15% of Ni and the balance being Fe and unavoidable impurities, and wherein said Fe-Cr-Ni alloy has a microstructure that is 60% or more strain-induced martensite based on a matrix.

2. An Fe-Cr-Ni alloy according to claim 1, wherein the Cr content is from 15 to 19%.

3. An Fe-Cr-Ni alloy according to claim 1, wherein the Ni content is from 5 to 13%.

4. A wear-resistant part of an automatic loom comprising a loom part that is in sliding contact with a yarn, wherein said loom part consists of the Fe-Cr-Ni alloy which consists by weight percentage, from 13 to 20% of Cr, from 4 to 15% of Ni and the balance being Fe and unavoidable impurities, and wherein said Fe-Cr-Ni alloy has a microstructure that is 60% or more strain-induced martensite based on a matrix.

5. A wear-resistant part of an automatic loom according to claim 4, wherein said part is a heald.

6. A wear-resistant part of an automatic loom according to claim 5, wherein said part is produced by blanking of the Fe-Ni-Cr alloy having a proportion of 60% or more of the strain induced martensite.

7. A wear-resistant part of an automatic loom according to claim 4, wherein said part is a reed blade.

8. A wear-resistant part of an automatic loom according to claim 7, wherein said part is produced by blanking of the Fe-Ni-Cr alloy having a proportion of 60% or more of the strain induced martensite.

9. An Fe-Cr-Ni alloy according to claim 1 or 4, wherein said microstructure is 70% or more of strain-induced martensite.

* * * * *